US009457819B2

(12) United States Patent
Ernst et al.

(10) Patent No.: US 9,457,819 B2
(45) Date of Patent: Oct. 4, 2016

(54) METHOD AND APPARATUS FOR LOCATING RAIL VEHICLES

(71) Applicant: SIEMENS AKTIENGESELLSCHAFT, Munich (DE)

(72) Inventors: Horst Ernst, Braunschweig (DE); Bernhard Evers, Braunschweig (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 14/419,001

(22) PCT Filed: Jul. 23, 2013

(86) PCT No.: PCT/EP2013/065469

§ 371 (c)(1),
(2) Date: Feb. 2, 2015

(87) PCT Pub. No.: WO2014/019886

PCT Pub. Date: Feb. 6, 2014

(65) Prior Publication Data

US 2015/0166087 A1 Jun. 18, 2015

(30) Foreign Application Priority Data

Jul. 31, 2012 (DE) ..... 10 2012 213 495

(51) Int. Cl.

| | |
|---|---|
| ***G05D 1/00*** | (2006.01) |
| ***B61L 25/02*** | (2006.01) |
| ***B61L 1/06*** | (2006.01) |
| ***B61L 1/14*** | (2006.01) |
| ***B61L 1/16*** | (2006.01) |

(52) U.S. Cl.

CPC ..... *B61L 25/025* (2013.01); *B61L 1/06* (2013.01); *B61L 1/14* (2013.01); *B61L 1/165* (2013.01); *B61L 1/166* (2013.01); *B61L 25/02* (2013.01)

(58) Field of Classification Search

CPC ..... B61L 1/06; B61L 1/14; B61L 1/165; B61L 1/166; B61L 23/00; B61L 25/02; B61L 25/025; G01P 5/26

USPC ..... 701/19, 20

See application file for complete search history.

(56) References Cited

U.S. PATENT DOCUMENTS

| | | | | |
|---|---|---|---|---|
| 5,330,136 | A * | 7/1994 | Colbaugh | B61L 1/06 246/122 R |
| 8,157,218 | B2 | 4/2012 | Riley et al. | |
| 2012/0217351 | A1 * | 8/2012 | Chadwick | B61L 23/06 246/169 R |

FOREIGN PATENT DOCUMENTS

| | | |
|---|---|---|
| CH | 381730 | 4/1964 |
| DE | 1154502 B | 9/1963 |

(Continued)

*Primary Examiner* — Muhammad Shafi

(74) *Attorney, Agent, or Firm* — Laurence Greenberg Werner Stemer; Ralph Locher

(57) ABSTRACT

A method for operating a locating device having a waveguide laid along a stretch of track to locate a rail vehicle on the stretch of track includes injecting electromagnetic pulses into the waveguide in succession or series and receiving and evaluating backscattering patterns produced by backscattering of the electromagnetic pulse for each emitted pulse. A vibration device located in the region of the stretch of track at a known position is activated at a predefined activation time and a vibration causing backscattering of the electromagnetic pulse is thereby produced at the known position, the duration between the activation time and the receipt of the backscattering pattern indicating the vibration is measured, and the measured duration is used to check the functionality or operation of the locating device or to calibrate the locating device. A locating apparatus for locating a rail vehicle along a stretch of track is also provided.

4 Claims, 2 Drawing Sheets

(56) References Cited

FOREIGN PATENT DOCUMENTS

| | | | |
|---|---|---|---|
| JP | S-61129549 | * | 6/1986 |
| JP | S61129549 | A | 6/1986 |
| WO | 2005056363 | A1 | 6/2005 |
| WO | 2011027166 | A1 | 3/2011 |

* cited by examiner

METHOD AND APPARATUS FOR LOCATING RAIL VEHICLES

BACKGROUND OF THE INVENTION

Field of the Invention

The invention relates to a method for operating a locating apparatus having a waveguide laid along a stretch of track for locating a rail vehicle on the stretch of track, which includes injecting a series of electromagnetic pulses into the waveguide and receiving and evaluating backscatter patterns produced by backscattering of the electromagnetic pulse for each pulse transmitted. The invention also relates to a locating apparatus for locating a rail vehicle along a stretch of track.

Such a method is known from international patent application WO 2011/027166 A1. In this already known method, to locate a rail vehicle along a stretch of track a waveguide is provided which is laid along the stretch of track. Electromagnetic pulses are successively injected into said waveguide. For each pulse emitted, at least one backscatter pattern produced by vehicle-induced backscattering of the electromagnetic pulse is received and evaluated. The location of the vehicle on the stretch of track is determined by evaluating the backscatter pattern.

BRIEF SUMMARY OF THE INVENTION

The object of the invention is to specify a method which provides reliable fault detection in the event of malfunction of the locating apparatus.

This object is achieved according to the invention by a method and a locating apparatus as described below. Advantageous embodiments of the method and the locating apparatus according to the invention are set forth in sub-claims.

Accordingly, it is inventively provided that a vibration device installed at a known position in the region of the stretch of track is activated at a predefined activation time, thereby producing at the known position a vibration causing backscattering of the electromagnetic pulse, the time between the activation time and the arrival of the backscatter pattern indicating the vibration is measured, and the measured time is used to check the operation of the locating apparatus or to calibrate the locating apparatus.

A significant advantage of the method according to the invention is that it enables the operation of the locating apparatus to be regularly checked with little cost/complexity. To perform a check, it is merely necessary to selectively generate a vibration and evaluate the behavior of the locating apparatus.

Preferably a fault signal indicating a malfunction of the locating apparatus is generated if the measured time reaches or exceeds a predefined maximum duration or if the measured time reaches or falls below a minimum duration. That is to say, in both cases the evaluation device can assume that the locating apparatus is not operating correctly, either because it is defective or because it has been tampered with.

In order to enable the locating apparatus to be checked without additional equipment complexity and therefore at minimal cost, it is considered advantageous if a mechanically movable outdoor element of the track system present anyway is activated as the vibration device, and the vibration and therefore the backscattering of the electromagnetic pulses is produced when the outdoor element is moved.

Switches, derails, semaphore signals or barrier gates are particularly suitable for producing vibrations, so it is considered advantageous for a switch, derail, semaphore signal or barrier gate to be moved as the outdoor element of the track system, and the vibration and therefore the backscattering of the electromagnetic pulses to be produced by the movement of an outdoor element of this kind.

The measured time can also be used to obtain a correction value which can be taken into account for locating rail vehicles on the stretch of track.

To locate a rail vehicle on the stretch of track, it is considered advantageous, for example, if the time between injection of the electromagnetic pulse into the waveguide and detection of the associated vehicle-induced backscatter pattern is measured, the correction value is subtracted from this time to produce a corrected time, and a position signal indicating the location of the vehicle is generated on the basis of the corrected time.

The invention also relates to a locating apparatus for locating a rail vehicle along a stretch of track using a waveguide laid along the stretch of track, a pulse generating device for generating and injecting successive electromagnetic pulses into the waveguide, a detection device for detecting backscatter patterns produced by backscattering, and an evaluation device which can evaluate the backscatter patterns to locate the rail vehicle.

In respect of a locating apparatus of this kind it is inventively provided that the locating apparatus has a vibration device located in a known position in the region of the stretch of track and connected to the evaluation device, said vibration device being activatable at a predefined activation time, enabling it to produce, at the known location, a vibration causing backscattering of the electromagnetic pulses, wherein the evaluation device is designed such that it can activate the vibration device at a predefined activation time and can use the time lapse between the arrival of the backscatter pattern indicating the vibration and the activation time to check the operation of the locating apparatus or to calibrate the locating apparatus.

In respect of the advantages of the locating apparatus according to the invention, reference is made to the above statements relating to the method according to the invention, as the advantages of the method according to the invention essentially correspond to those of the locating apparatus according to the invention.

It is considered to be particularly advantageous if the evaluation device is designed such that it generates a fault signal indicating a malfunction of the locating apparatus if the measured time reaches or exceeds a maximum duration or if the measured time reaches or falls below a minimum duration.

The vibration device is preferably constituted by an outdoor element of the track system, with particular preference by a switch, a derail, a semaphore signal or a barrier gate.

BRIEF DESCRIPTION OF THE SEVERAL VIEWS OF THE DRAWING

The invention will now be explained in greater detail with reference to exemplary embodiments and the accompanying drawings in which.

DESCRIPTION OF THE INVENTION

Figure 1:
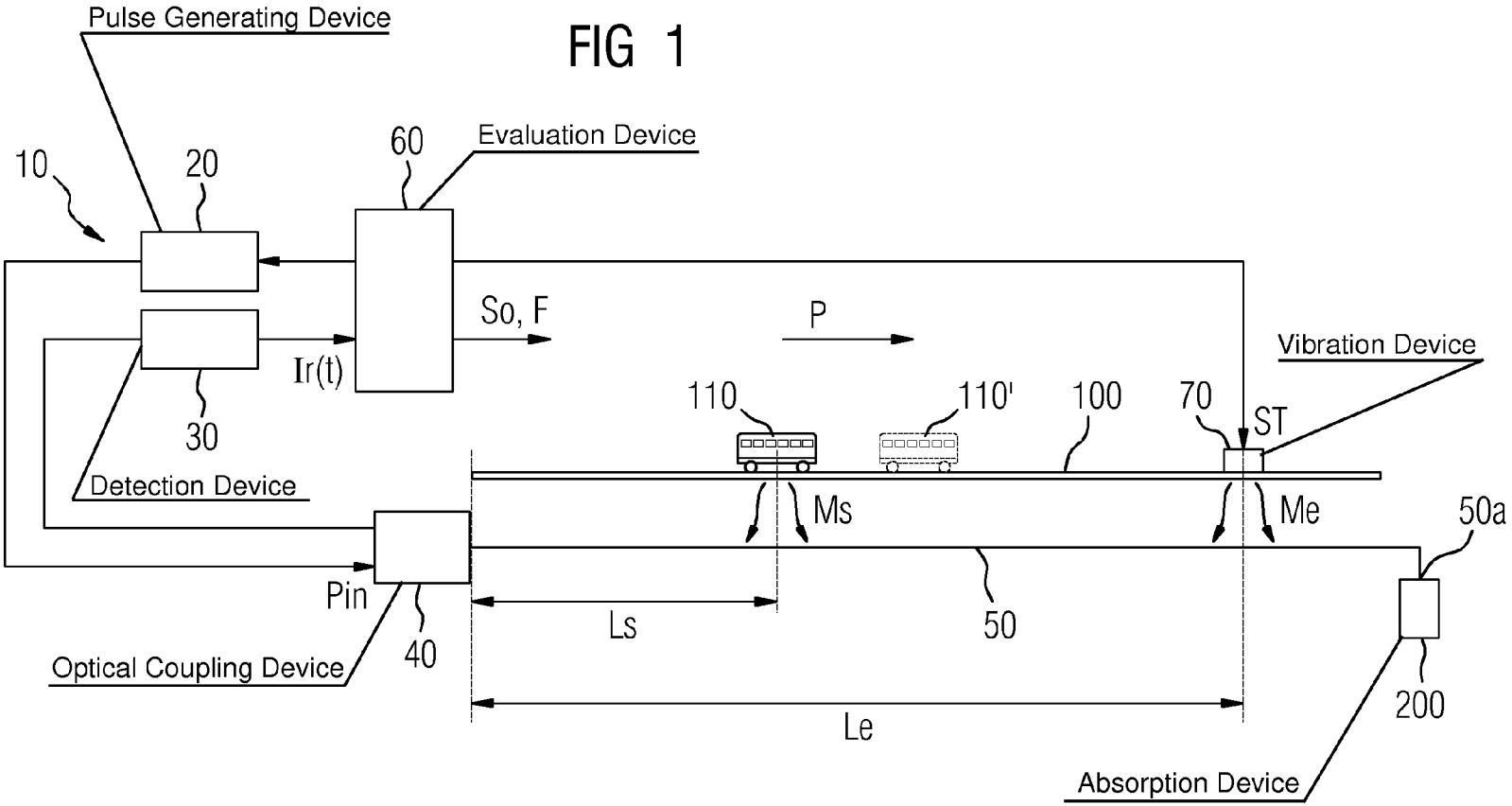
FIG. 1 shows an example of an inventive locating apparatus for locating a rail vehicle along a stretch of track.

For the sake of clarity, identical or comparable components are denoted by the same reference characters throughout the drawings.

FIG. 1 shows a locating apparatus 10 comprising a pulse generating device 20, a detection device 30, an optical coupling device 40, a waveguide 50, e.g. in the form of a fiberoptic waveguide, an evaluation device 60, and a vibration device 70 located at a known position.

The pulse generating device 20 preferably has a laser (not shown) enabling short electromagnetic, in particular optical pulses to be regularly generated, e.g. at a fixed pulse rate, and to be injected into the waveguide 50 via the coupling device 40. The pulse generating device 20 is preferably controlled by the evaluation device 60 so that the pulse generation times are at least approximately known to the evaluation device 60.

The detection device 30 has, for example, a photodetector for detecting the electromagnetic radiation. The detection device 30 transmits its measurement signals to the evaluation device 60 which evaluates them.

As shown in FIG. 1, the waveguide 50 is disposed along a stretch of track 100. A rail vehicle 110 is traveling on the stretch of track 100 from left to right in the direction of the arrow P.

To locate the rail vehicle 110, the locating apparatus 10 according to FIG. 1 can, for example, be operated as follows:

The evaluation device 60 triggers the pulse generating device 20 to inject a series of electromagnetic pulses Pin into the waveguide 50 via the coupling device 40. The generated electromagnetic pulses Pin travel from left to right in the direction of the arrow P in FIG. 1 and are preferably absorbed by an absorption device 200 at the waveguide end 50*a*.

The rail vehicle 110 running over the stretch of track 100 causes the waveguide 50 to be locally vibrated, or made to oscillate; this is indicated in FIG. 1 by arrows having the reference character Ms. These oscillations or vibrations of the waveguide 50 cause backscattering of the electromagnetic radiation to occur locally in the area where the rail vehicle 110 is currently located. The backscattered radiation runs counter to the direction of travel P of the rail vehicle 110, i.e. counter to the direction of the arrow P in the direction of the coupling device 40 and in the direction of the detection device 30 where it is detected by the detection device 30. The intensity of the backscattered radiation Ir(t) measured by the detection device 30 over time t is shown in FIG. 2.

Figure 2:
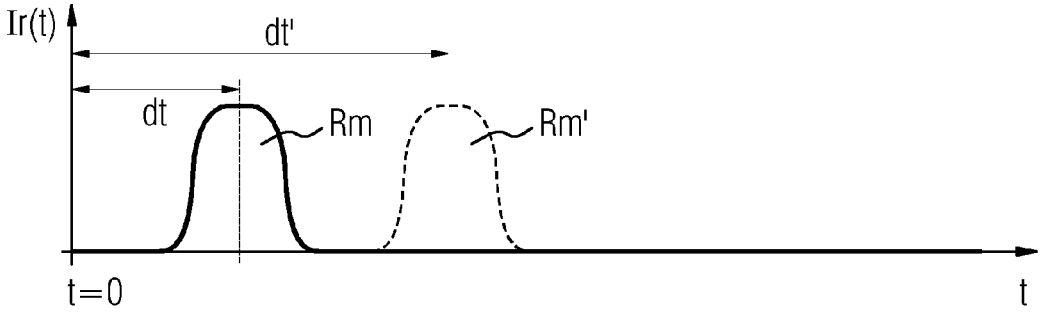
FIG. 2 shows examples of backscatter patterns produced by the rail vehicle according to FIG. 1.

It can be seen from FIG. 2 that the backscattered radiation Ir(t) has a backscatter pattern Rm that is indicative of the vibration caused by the rail vehicle 110 and coupled into the waveguide 50. The evaluation device 60 is designed to evaluate the times elapsing between the injection of the electromagnetic pulses Pin into the waveguide 50 and the detection of the associated backscatter patterns Rm.

As FIG. 2 shows, the time dt elapses between the electromagnetic starting pulse which, in the representation according to FIG. 1, has been generated at time t=0, and detection of the associated backscatter pattern Rm. The time interval dt is based on the transit time dh of the electromagnetic pulse in the waveguide 50 in the rail vehicle direction, the transit time dr of the electromagnetic backscatter pattern in the waveguide 50 in the direction of the detection device 30, and a system-related delay dv which is required for pulse generation, detection of the backscattered radiation Ir(t) and computer-aided evaluation of the backscattered radiation to recognize the backscatter patterns, therefore:

$$dt=dr+dh+dv$$

It is self-evident that time interval dt will increase the farther the rail vehicle 110 is from the pulse generating device 20 or detection device 30, as the transit times dh and dr will increase. The system-related delay dv will remain approximately constant or vary stochastically within certain limits.

This situation is indicated by way of example in FIG. 2 by a dashed backscatter pattern Rm' which has been obtained at a later point in time when the rail vehicle 110 has travelled further in the direction of the arrow P. The corresponding position of the rail vehicle is represented by dashed lines in FIG. 1 where it is denoted by the reference character 110'.

The evaluation device 60 is therefore able, on the basis of the time interval dt or dt' as the case may be, to determine the location of the rail vehicle 110 and generate a corresponding position signal So; it can disregard the system-related delay dv or take it into account if it is known by subtracting the system-related delay dv. The location of the rail vehicle 110 can be calculated e.g. according to:

$$Ls=\tfrac{1}{2}*(dt-dv)/V$$

where Ls denotes the length of the waveguide section between the pulse generating device 20 or rather the detection device 30 and the respective position of the rail vehicle 110, and V the velocity of the pulses in the waveguide 50. The factor ½ allows for the fact that the radiation has to pass through the respective waveguide section at least twice, namely once in the outward direction and once in the return direction.

The velocity V is given e.g. by:

$$V=c0/n$$

where c0 is the speed of light and n the refractive index in the waveguide 50.

FIG. 1 also shows that the vibration device 70 installed at a known position in the region of the stretch of track 100 is connected to the evaluation device 60 and can be activated by the latter by means of an activation signal ST. Said vibration device 70 is preferably an outdoor element of the track system of the stretch of track 100, in particular a switch, a derail, a semaphore signal or a barrier gate. When actuated, these devices produce mechanical oscillations which vibrate the ground and can therefore be selectively used as vibration devices, even though that is not their primary function.

Figure 3:
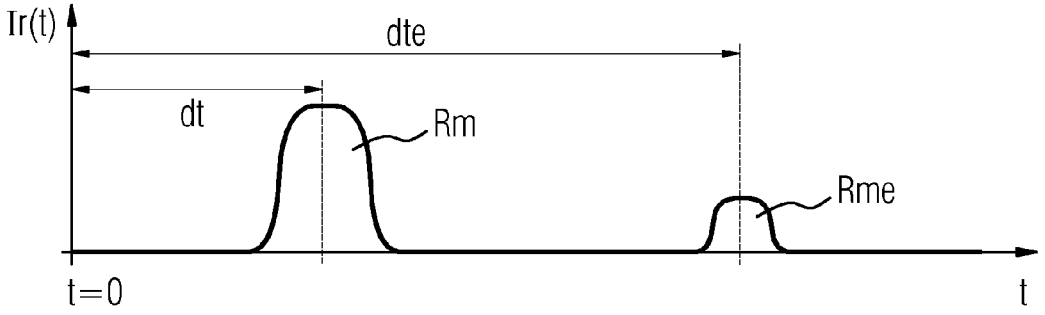
FIG. 3 shows a typical backscatter pattern produced by a vibration device of the locating apparatus according to FIG. 1.

If the vibration device 70 is activated by means of the activation signal ST, it produces vibrations which are denoted in FIG. 1 by arrows having the reference character Me. These vibrations likewise result in backscattering of the electromagnetic pulses Pin and produce a characteristic backscatter pattern Rme which is detectable in the intensity signal Ir(t) in FIG. 3. FIG. 3 shows both the backscatter pattern Rme of the vibration device 70 and the backscatter pattern Rm of the rail vehicle 110 according to FIG. 1 which is located between the pulse generating device 20, or the detection device 30, and the vibration device 70.

The backscatter pattern Rme of the vibration device 70 is produced at a known location in the waveguide 50, because the location of the vibration device 70 in the track system is known. The distance between the vibration device 70 and the coupling device 40 is denoted by the reference character Le in FIG. 1.

The evaluation device 60 will measure the time Tv between generation of the activation signal ST and detection of the characteristic backscatter pattern Rme and produce a fault signal F if the time Tv is too long or too short or, in other words, reaches or exceeds a predefined maximum duration Tmax or reaches or falls below a predefined minimum duration Tmin:

$Tv \geq Tmax \Rightarrow$ fault signal F is produced $Tv \leq Tmin \Rightarrow$ fault signal F is produced In both cases the evaluation device 60 assumes that the locating apparatus 10 is not operating correctly, either because it is defective or has been tampered with.

As the time Tv approximately corresponds to the system-related delay dv or is at least approximately proportional thereto, the evaluation device 60 can use the time Tv to produce a correction value K which can be taken into account for locating the rail vehicle 110 on the stretch of track 100, e.g. according to:

$$K=p*Tv,$$

where p is a proportionality factor.

The evaluation device can take the correction value K into account, for example, by subtracting the correction value K from each future time measurement to produce a corrected time duration and generating a position signal So indicating the location of the rail vehicle on the basis of the corrected time duration.

Additionally or alternatively, the evaluation device 60 can determine the system-related delay dv during operation of the vibration device 70 by continuing to evaluate the time lapse dte between generation of the electromagnetic pulses Pin and detection of the respective backscatter pattern Rme in each case (cf. FIG. 3).

As the distance Le from the vibration device 70 is known, the evaluation device 60 can determine the system-related delay dv required for pulse generation, detection and evaluation of the backscatter pattern by subtracting the transit times of the electromagnetic pulses in the waveguide 50 from the measured time dte, e.g. a follows:

$$dv=dte-Le/(2*V),$$

As explained above, the measured value for the measured system-related delay is preferably taken into account for determining the location.

Although the invention has been illustrated and described in detail using exemplary embodiments, the invention is not limited to the examples disclosed and other variations may be deduced therefrom by the average person skilled in the art without departing from the scope of protection sought for the invention.

LIST OF REFERENCE CHARACTERS

10 locating apparatus
20 pulse generating device
30 detection device
40 coupling device
50 waveguide
50*a* waveguide end
60 evaluation device
70 vibration device
100 stretch of track
110 rail vehicle
110' rail vehicle
200 absorption device
dt time lapse
dt' time lapse
dte time lapse
F fault signal
Ir(t) backscattered radiation
Le distance from vibration device
Ls distance from rail vehicle
Me vibration caused by vibration device
Ms vibration caused by rail vehicle
P direction of arrow/direction of travel
Pin electromagnetic pulses
Rm backscatter pattern
Rm' backscatter pattern
Rme backscatter pattern
So position signal
ST activation signal
t point in time

The invention claimed is:

1. A locating apparatus for locating a rail vehicle along a stretch of track, the locating apparatus comprising:

a waveguide laid along the stretch of track;

a pulse generating device configured to generate and inject a sequence of electromagnetic pulses into said waveguide;

a detection device configured to detect backscatter patterns caused by backscattering;

an evaluation device configured to evaluate the backscatter patterns to locate the rail vehicle; and a vibration device installed at a known position in a region of the stretch of track and connected to said evaluation device, said vibration device being activatable at a predefined point in time permitting said vibration device to produce a vibration at the known position causing backscattering of the electromagnetic pulses;

said evaluation device configured to activate said vibration device at a predefined activation point in time and to use a measured time period between arrival of the backscatter pattern indicating the vibration and the activation point in time to check functionality of the locating apparatus or to calibrate the locating apparatus.

2. The locating apparatus according to claim 1, wherein said evaluation device is configured to generate a fault signal indicating a malfunction of the locating apparatus:

if the measured time reaches or exceeds a predefined maximum duration or if the measured time reaches or falls below a predefined minimum duration.

3. The locating apparatus according to claim 1, wherein said vibration device is an outdoor element of a track system.

4. The locating apparatus according to claim 3, wherein said outdoor element of the track system is a switch, a derail, a semaphore signal or a barrier gate.

* * * * *